US012331541B2

(12) United States Patent
Driever et al.

(10) Patent No.: US 12,331,541 B2
(45) Date of Patent: Jun. 17, 2025

(54) FOLDABLE COVER FOR A SWIMMING POOL HAVING OPPOSITE STRAIGHT SIDES

(71) Applicant: Dutch Toys Group Holding B.V., Doetinchem (NL)

(72) Inventors: Stijn Gerard Driever, Doetinchem (NL); Jeroen van den Bosch, Doetinchem (NL); Jeroen Hendrik Johan Koeslag, Doetinchem (NL)

(73) Assignee: Dutch Toys Group Holding B.V., Doetinchem (NL)

( * ) Notice: Subject to any disclaimer, the term of this patent is extended or adjusted under 35 U.S.C. 154(b) by 122 days.

(21) Appl. No.: 18/316,649

(22) Filed: May 12, 2023

(65) Prior Publication Data

US 2023/0383563 A1 Nov. 30, 2023

(30) Foreign Application Priority Data

May 30, 2022 (NL) ..... 2032016

(51) Int. Cl.
*E04H 4/10* (2006.01)

(52) U.S. Cl.
CPC ..... *E04H 4/108* (2013.01)

(58) Field of Classification Search
CPC ..... E04H 4/108; E04H 4/10; E04H 4/088; E04H 15/38; E04H 15/40; E04H 15/405; E04H 15/425; E04H 15/42
USPC ..... 4/503
See application file for complete search history.

(56) References Cited

U.S. PATENT DOCUMENTS

| | | | | |
|---|---|---|---|---|
| 3,683,427 | A * | 8/1972 | Burkholz | E04H 4/108 52/80.1 |
| 5,746,237 | A * | 5/1998 | Arnic | E04H 15/38 52/DIG. 14 |
| 6,272,695 | B1 | 8/2001 | Brandner | |
| 7,051,481 | B2 * | 5/2006 | Delavega | E04H 6/04 52/64 |
| 8,448,268 | B2 * | 5/2013 | Bradshaw | E04H 4/14 211/100 |
| 8,899,251 | B2 * | 12/2014 | Leung | E04H 15/40 135/96 |
| 10,077,568 | B2 * | 9/2018 | Huber | E04H 4/088 |
| 11,053,700 | B2 | 7/2021 | van den Bosch et al. | |
| 11,149,454 | B1 | 10/2021 | Andrews | |
| 2020/0240162 | A1 * | 7/2020 | van den Bosch | E04H 4/108 |

* cited by examiner

*Primary Examiner* — Erin Deery
(74) *Attorney, Agent, or Firm* — Oppedahl Patent Law Firm LLC

(57) ABSTRACT

The present invention relates to a foldable cover (1) for a swimming pool (100). The cover comprises a foldable cover material (2), a number of supports (3) extending over the cover material for folding and unfolding the cover material and two support units (10) to be arranged on opposite sides of the cover (1) for rotatable attachment of outer ends of a number of the supports (3). The support units comprise attaching means for releasably attaching the support units to the swimming pool. The attaching means (12) are arranged for adjustable clamping between adjacent legs (102) of the swimming pool.

14 Claims, 4 Drawing Sheets

FOLDABLE COVER FOR A SWIMMING POOL HAVING OPPOSITE STRAIGHT SIDES

The present invention refers to a foldable cover for a swimming pool, wherein the cover comprises a foldable cover material, a number of supports extending over the cover material for folding and unfolding the cover material and two support units to be arranged on opposite sides of the cover for rotatable attachment of outer ends of a number of the supports around first rotation axes, wherein the support units comprise attaching means for releasably attaching the support units to the pool.

BACKGROUND

A foldable cover according to the preamble is known per se in the art and is designed to protect a swimming pool from dirt as well as to provide shelter to users of the swimming pool against weather conditions, such as wind and ultraviolet radiation. Additionally the cover has a greenhouse effect and ensures that the water in the swimming pool is heated by the sun. The known cover can be easily put in a folded (open) position, an unfolded (closed) position or even a semi-folded position. The known cover is arranged for use with a specific type of swimming pool.

Many swimming pools comprises a rail, more specifically a top rail. Preferably the support units are positioned below the rail and consequently the supports with cover material are positioned below the rail in the folded position, where they can conveniently remain. In the unfolded position the cover material stretches downwardly past the rail. A better shield from wind and rain is thus obtained and more dirt can be kept out.

A foldable cover according to the preamble of claim 1 is known from the U.S. patent Ser. No. 11/053,700 of the same applicant, issued Jul. 6, 2021. The known foldable cover is especially suitable for use in round swimming pools.

SUMMARY OF THE INVENTION

The invention has for its object to provide a foldable cover of the type stated in the preamble of claim 1 that is especially suitable for use in unround swimming pools.

The foldable cover according to the present invention is thereto characterized in that the attaching means are arranged for adjustable clamping between adjacent legs of the swimming pool.

The attaching means of the foldable cover according to the present invention can be adjusted to fit clampingly between adjacent legs of various types of swimming pools having different constructive dimensions. This makes the foldable cover according to the present invention truly universal.

In a first preferred embodiment of the foldable cover according to the present invention the attaching means comprise a clamp rod. A clamp rod is specifically suitable for use in unround swimming pools, such as rectangular swimming pools. The clamp rod can advantageously be arranged for easy length adjustment, for instance by mechanical adjustment, such as by turning or shifting.

In a further elaboration of the first preferred embodiment the clamp rod is provided at its outer ends with grips arranged to rest against a leg of the swimming pool. Preferably the grips are U-shaped. The U-shapes nicely fit around tubular legs that are widely used in frame pools, i.e. a specific type of swimming pool that comprises a top rail and a number of legs for connection to the top rail.

In a robust and stable preferred embodiment of the foldable cover according to the present invention each support unit is further provided with a spacer that is arranged to rest against the adjacent legs of the swimming pool that the attaching means extend between in a position of use. According to a further elaboration the spacer extends above the clamp rod. Preferably the spacer has an elongated shape, such as a tubular shape. In this robust and stable preferred embodiment the foldable cover according to the present invention is especially suitable for use with a frame pool.

In a practical preferred embodiment the foldable cover according to the present invention further comprises fastening means for fastening the spacer to the swimming pool. The fastening means assist a user in positioning the support units at a suitable height. Suitable fastening means comprise clamps or a hook.

In a practical embodiment of the foldable cover according to the present invention one of the supports is to be attached fixedly at its outer ends to the support units and forms an end support. In the folded position all rotatable supports are laid down on the end support.

In an elegant embodiment of the foldable cover according to the present invention each support unit comprises a housing provided with a first and a second surface that are spaced apart, wherein the first rotation axes extend transverse through both the first and the second surface.

In a universal embodiment the foldable cover according to the present invention is substantially semi-cylindrical in shape. A semi-cylinder forms a perfect fit for a rectangular pool.

In a cost-efficient elaboration of the universal embodiment the supports are made of metal.

Preferably the cover material comprises PVC (polyvinyl chloride) or PE (polyethylene). More preferably the cover material is transparent.

The invention also relates to an assembly of a foldable cover according to the invention and a frame pool, said frame pool comprising a top rail and a number of legs for connection to the top rail.

DESCRIPTION OF THE DRAWING

The invention will now be described in more detail with reference to the figures.

The same components are designated in the figures with the same reference numerals.

DETAILED DESCRIPTION

Figure 1A:
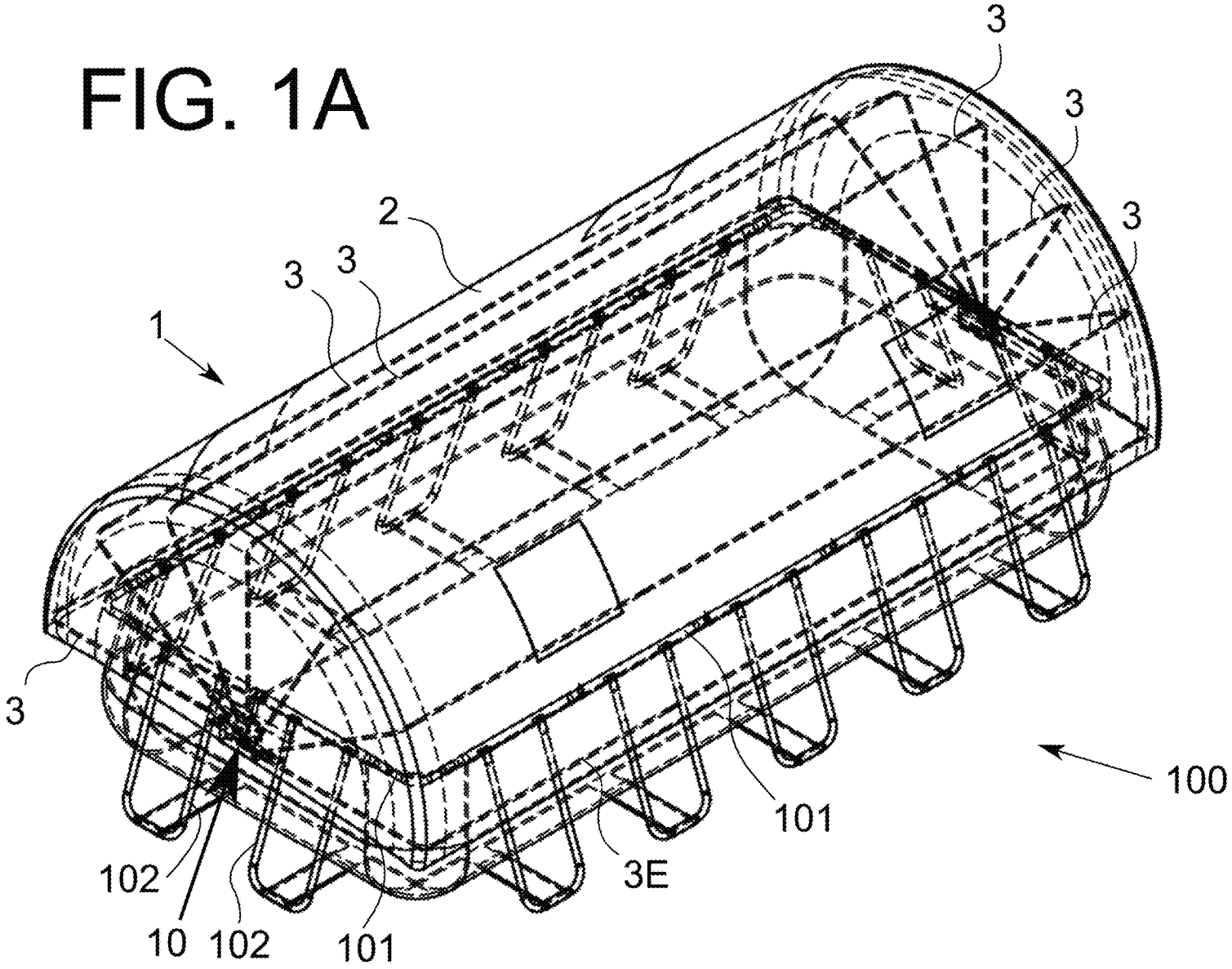
FIG. 1A shows a schematic view of a preferred embodiment of a frame pool and a cover according to the present invention with the cover in an unfolded position.
Figure 1B:
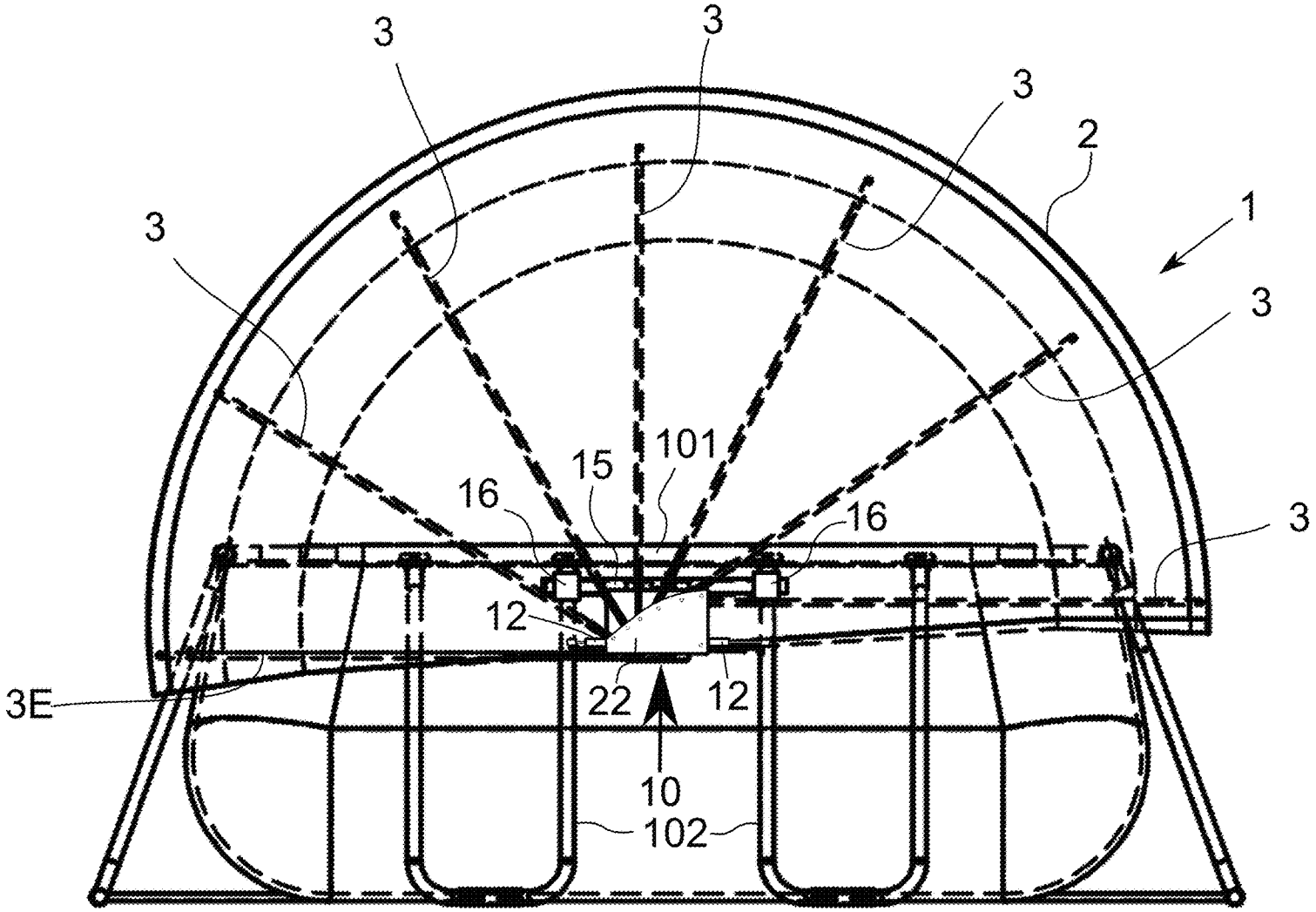
FIG. 1B schematically shows the preferred embodiment of FIG. 1A in a side view.

FIG. 1A schematically shows a preferred embodiment of a swimming pool 100 and a foldable cover 1 according to the present invention with the cover in an unfolded position. FIG. 1B schematically shows a side view of the preferred embodiment of FIG. 1A.

The foldable cover 1 comprises a foldable cover material 2 and several supports 3 for folding and unfolding the cover material 2 and two support units 10 to be arranged on opposite sides of the cover for rotatable attachment of outer ends of several supports 3.

According to the invention the cover 1 is specifically designed to be releasable attached to opposite straight sides of a swimming pool. In the figures the swimming pool is a rectangular frame pool 100 that is typically provided with a top rail 101 and several legs 102 for connection to the top rail 101.

Figure 2A:
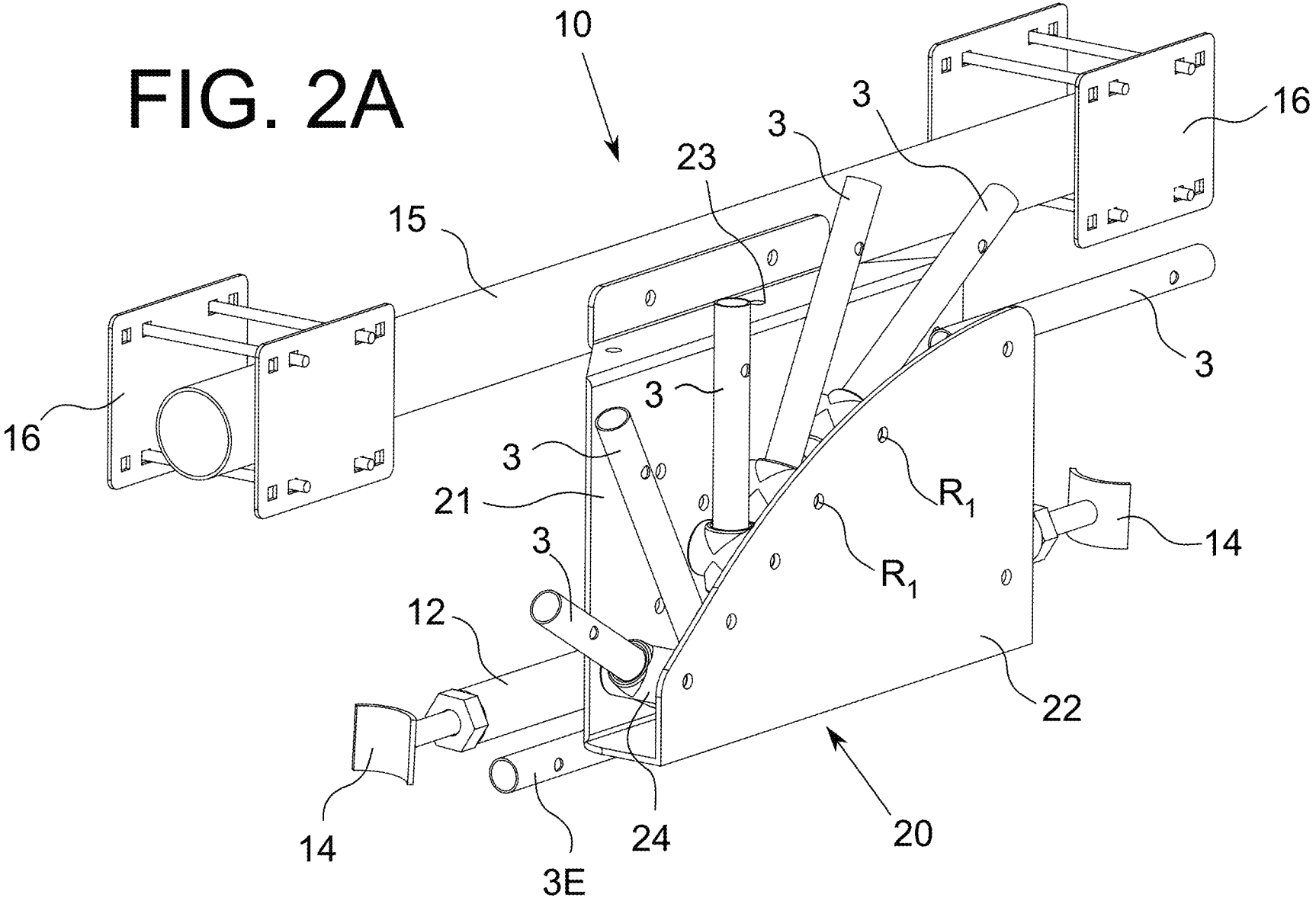
FIG. 2A shows a schematic view of a first preferred embodiment of a support unit as part of the cover of FIG. 1B.

FIG. 2A shows a schematic view of a first preferred embodiment of a support unit 10 as part of the cover in the unfolded position.

The support unit 10 has a housing 20 that accommodates the outer ends of the supports 3 as will be described below.

The support unit 10 is further provided with attaching means 12 for releasably attaching the support unit 10 on the legs 102 of the frame pool 100. According to the invention the attaching means 12 are arranged for adjustable clamping between two adjacent legs 102 of the frame pool 100.

In the preferred embodiment the attaching means comprise a clamp rod 12 that is provided at its outer ends with grips 14 arranged to engage on a leg 102 of the frame pool 100. The clamp rod 12 has an adjustable length. Preferably the grips 14 are U-shaped.

In the preferred embodiment of each support unit 10 the housing 20 comprises a first surface 21 and a second surface 22 that are spaced apart. The outer ends of several bowed supports 3 are attachable to rotation shafts 24 that are present in the support unit 10 to allow rotation of said bowed supports 3 with the cover material 2 around first rotation axes R1. The first rotation shafts 24 extend transverse through both the first and the second surface 21 respectively 22.

One of the supports 3 is to be attached fixedly at its outer ends to the support units 10 and forms an end support 3E. The end support 3E defines the position of rest of the other supports 3 in the folded position of the cover shown in FIG. 2B.

Each support unit 10 is further provided with a spacer 15 that is arranged to rest against the adjacent legs 102 of the swimming pool that the clamp rod 12 extends between in the position of use. Preferably the spacer 15 has an elongated shape, such as a tubular shape. In the preferred embodiment shown the spacer 15 is attached to the back of the housing 20 above the clamp rod 12. In the preferred embodiment shown the spacer 15 extends substantially parallel to clamp rod 12.

The first surface 21 is at an upper edge connected to a third surface 23 which is oriented substantially transversely or obliquely to the first surface 21. In the preferred embodiment the housing 20 is connected to the spacer 15 by means of the third surface 23.

Optionally the fastening means 16 are provided to fasten the spacer 15 to the legs 102. Suitable fastening means are clamps 16.

Figure 2B:
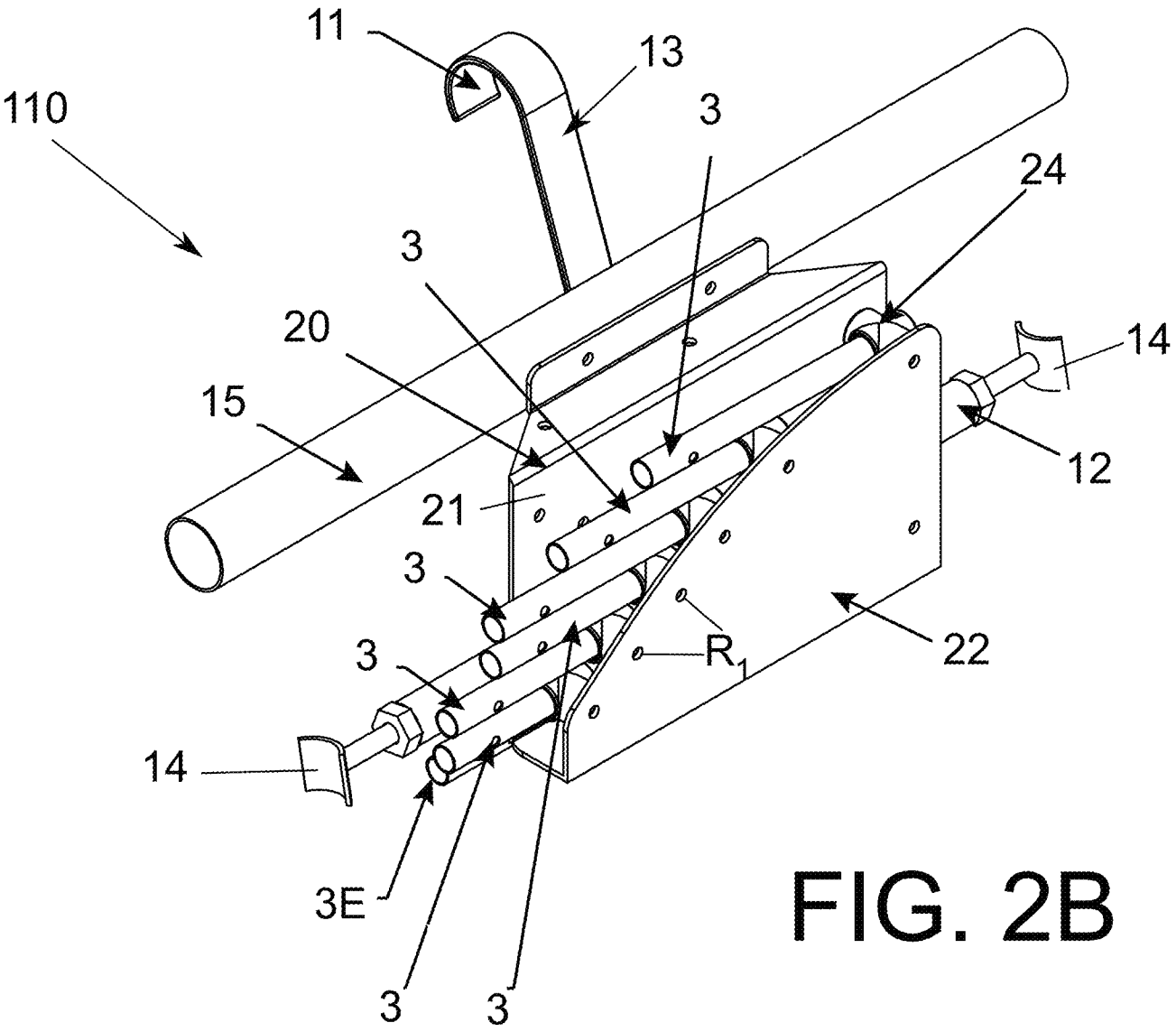
FIG. 2B shows a schematic view of a second preferred embodiment of a support unit.

FIG. 2B shows a schematic view of a second preferred embodiment of a support unit 110 in the folded position.

The support unit 110 differs from the support unit 10 in that it has alternative fastening means that in the preferred embodiment shown comprise at least one suspension arm 13. The suspension arm 13 is connected to the spacer 15. The suspension arm 13 is provided with suspension means 11 for releasably suspending the support unit 10 on the top rail 101 of the frame pool 100. In the preferred embodiment shown the suspension means comprise a hook 11. The size of the hook can be chosen such that one size fits the top rails of many different types of swimming pools.

The foldable cover material 2 is tensioned by the supports 3. In the preferred embodiment the cover material 2 is provided with sleeves or pockets (not shown) through which the supports 3 can extend. Preferably the cover material is transparent. Suitable cover materials include PVC and PE.

The supports 3 are preferably made of metal.

In the preferred embodiment shown the frame pool 100 has a generally rectangular shape and the supports 3 comprise angles and the cover 1 is generally semi-cylindrically shaped.

The invention is of course not limited to the described and shown preferred embodiments. For example, the cover and/or the supports may have a different shape and/or the number of supports may vary. These are only some examples of variants that lie within reach of a person skilled in the art. Consequently, the invention extends to any embodiment falling within the scope of protection as defined in the claims and as seen in the light of the foregoing description and accompanying drawings.

The invention claimed is:

1. A foldable cover for a swimming pool, wherein the cover comprises a foldable cover material, a number of supports extending under the cover material for folding and unfolding the cover material and two support units arranged on opposite sides of the cover for rotatable attachment of outer ends of a number of the supports around first rotation axes, wherein the support units comprise attaching means for releasably attaching the support units to the pool, wherein the attaching means are arranged for adjustable clamping between adjacent legs of the swimming pool, wherein the attaching means comprise a clamp rod having an adjustable length, wherein the clamp rod extends between the adjacent legs of the swimming pool in a position of use, wherein the clamp rod has outer ends and is provided at said outer ends with grips that rest against the adjacent legs of the swimming pool in the position of use.

2. The foldable cover according to claim 1, wherein the supports have outer ends and one of the supports is to be attached fixedly at said outer ends to the support units and forms an end support.

3. The foldable cover according to claim 1, wherein each support unit comprises a housing provided with a first and a second surface that are spaced apart, wherein the first rotation axes extend transverse through both the first and the second surface.

4. The foldable cover according to claim 1, wherein the cover is semi-cylindrical in shape.

5. The foldable cover according to claim 1, wherein the supports are made of metal.

6. The foldable cover according to claim 1, wherein the cover material comprises PVC or PE.

7. The foldable cover according to claim 1, wherein the cover material is transparent.

8. An assembly of a foldable cover according to claim 1 and a frame pool, said frame pool comprising a top rail and a number of adjacent legs for connection to the top rail.

9. The foldable cover according to claim 1, wherein the grips are U-shaped.

10. A foldable cover for a swimming pool, wherein the cover comprises a foldable cover material, a number of supports extending under the cover material for folding and unfolding the cover material and two support units arranged on opposite sides of the cover for rotatable attachment of outer ends of a number of the supports around first rotation axes, wherein the support units comprise attaching means for releasably attaching the support units to the pool, wherein the attaching means are arranged for adjustable clamping between adjacent legs of the swimming pool, wherein each support unit is further provided with a spacer that is arranged to rest against the adjacent legs of the swimming pool that the attaching means extend between in a position of use.

11. The foldable cover according to claim 10, wherein the spacer extends above a clamp rod, and wherein the attaching means comprises the clamp rod.

12. The foldable cover according to claim 10, wherein the spacer has an elongated shape.

13. The foldable cover according to claim 12, wherein the spacer has a tubular shape.

14. The foldable cover according to claim 10, further comprising fastening means for fastening the spacer to the swimming pool.

* * * * *